United States Patent [19]

Mirzadeh et al.

[11] Patent Number: 4,664,869

[45] Date of Patent: May 12, 1987

[54] METHOD FOR THE SIMULTANEOUS PREPARATION OF RADON-211, XENON-125, XENON-123, ASTATINE-211, IODINE-125 AND IODINE-123

[75] Inventors: Saed Mirzadeh, East Setauket; Richard M. Lambrecht, Quogue, both of N.Y.

[73] Assignee: The United States of America as represented by the United States Department of Energy, Washington, D.C.

[21] Appl. No.: 750,123

[22] Filed: Jul. 1, 1985

[51] Int. Cl.[4] ..... G21G 1/10

[52] U.S. Cl. ..... 376/195; 376/202; 423/249

[58] Field of Search ..... 376/192, 194, 195, 198, 376/190, 202; 423/429

[56] References Cited

U.S. PATENT DOCUMENTS

| | | | |
|---|---|---|---|
| 3,966,547 | 6/1976 | Blue | 376/192 |
| 4,088,532 | 5/1978 | Blue | 376/198 |
| 4,106,982 | 8/1978 | Christman et al. | 376/195 |
| 4,364,898 | 12/1982 | Meyer et al. | 376/190 |

FOREIGN PATENT DOCUMENTS

| | | | |
|---|---|---|---|
| 0096730 | 12/1983 | European Pat. Off. | 376/195 |

OTHER PUBLICATIONS

Int. J. of Applied Rad. & Isotopes, vol. 31, pp. 163–167, Adilbish et al.

J. Inorg. Nucl. Chem., 1966, vol. 28, pp. 771–794, No. 3, Rudstam et al.

J. Inorg. Nucl. Chem. 1976, vol. 38, pp. 37–39, Kandil.

Radiochem. Radioanal. Letters 25(5–6), pp. 377–390, 1976, Meyer et al.

J. Inorg. Nucl. Chem., 1976, vol. 38, pp. 31–36, Eaker et al.

Int. J. of Applied Rad. & Isotopes, Nov. 1976, No. 11, vol. 27, pp. 597–603, Cuninghame et al.

J. of Radioanalytical Chemistry, vol. 21, (1974), pp. 199–209.

Int. J. Radiat. Isot. vol. 35, No. 11, pp. 1005–1008, 1984, Harrison et al.

Int. J. of Applied Rad. & Istopes. vol. 31, pp. 351–355, 1980, Meyer et al.

Visser et al. Abstract of paper published in "Int. J. Appl. Radiat. Isot. vol. 30, No. 12, pp. 745–748, 1979".

*Primary Examiner*—Harvey E. Behrend

*Attorney, Agent, or Firm*—Vale P. Myles; James W. Weinberger; Judson R. Hightower

[57] ABSTRACT

A method for simultaneously preparing Radon-211, Astatine-211, Xenon-125, Xenon-123, Iodine-125 and Iodine-123 in a process that includes irradiating a fertile metal material then using a one-step chemical procedure to collect a first mixture of about equal amounts of Radon-211 and Xenon-125, and a separate second mixture of about equal amounts of Iodine-123 and Astatine-211.

13 Claims, 2 Drawing Figures

METHOD FOR THE SIMULTANEOUS PREPARATION OF RADON-211, XENON-125, XENON-123, ASTATINE-211, IODINE-125 AND IODINE-123

The U.S. Government has rights in this invention pursuant to Contract Number DE-AC02-76CH00016, between the U.S. Department of Energy and Associated Universities Inc.

BACKGROUND OF THE INVENTION

The invention relates to a practical method for commercially producing radiopharmaceutical activities and, more particularly, relates to a method for the preparation of about equal amount of Radon-211 ($^{211}Rn$) and Xenon-125 ($^{125}Xe$) including a one-step chemical procedure following an irradiation procedure in which a selected target of Thorium ($^{232}Th$) or Uranium ($^{238}U$) is irradiated. The disclosed method is also effective for the preparation in a one-step chemical procedure of substantially equal amounts of high purity $^{123}I$ and $^{211}At$.

In many research applications it is desirable to have available the relatively long-lived radio-iodine isotope labels that have been found to be very useful in studying disease processes. In other applications, such as for therapeutic radiation dose treatment of certain human diseases, it has been found that the radionuclide $^{211}At$ is very useful. It is also known that $^{123}I$ is ideal for imaging in nuclear medicine, while $^{211}At$ has desirable properties as a label of therapeutic radiopharmaceuticals that are used in the treatment of human diseases such as cancer and rheumatoid arthritis. Accordingly, it is recognized that a method for affording simultaneous production of about equal amounts of $^{125}Xe$ and $^{211}Rn$ would be of considerable value in making systematic investigations of the energetic and ionic reactions of $^{125}I$ and $^{211}At$ (the daughters of $^{125}Xe$ and $^{211}Rn$, respectively) during excitation labeling of organic compounds. Moreover, conclusions concerning the chemistry of astatine are often drawn by extrapolation from iodine chemistry. Moreover, it is desirable to label organic compounds intended for biomedical studies with both iodine and astatine isotopes in order to ascertain biochemical behavior and in vivo stability. Thus, a method of preparing both the radionuclides ($^{211}Rn$ and $^{125}Xe$) in a relatively carrier-free state is of value, because such extrapolations will thus be made more economically practical in view of the fact that with such a method the radiochemical yields can be optimized.

Before the development of the invention disclosed herein, it is not believed that any other processes or methods existed for the commercially practical, simultaneous preparation of substantially equal amounts of $^{211}Rn$ and $^{125}Xe$. By practicing the method of the invention, such useful quantities of high radionuclidic purity, carrier-free $^{211}At$ and $^{125}I$ can be readily prepared. Accordingly, by the method of the invention, a single source containing both of those parent radionuclides is made available for dual-tracer preparation of radiopharmaceuticals, such as monoclonal antibodies.

Also, the method of the invention enables the preparation of high purity $^{123}I$ and $^{211}At$, in the same chemical form and media, so that truly double-labeled compounds, which must be obtained in high specific activity for diagnostic and therapeutic applications, can be achieved. The chemistry of $^{211}At$ is particularly difficult, because there are no stable isotopes of that element, so chemistry with $^{211}At$ is generally based upon extrapolation from iodine chemistry. Thus, it is believed that the types of double-labeled radiopharmaceuticals, that can be economically prepared by practicing the method of the invention, will have future applications where the labeled compound can be administered to a patient, with the $^{123}I$ label being used to locate a given desired site, such as the site of a tumor, for example, while the $^{211}At$ is used for therapeutic treatment of the site. As indicated above, $^{211}At$ does not have nuclear decay properties that would permit its use for imaging and, on the other hand, there are no alpha-emitting radionuclides of iodine, which would permit their therapeutic use.

Prior to the present invention, it was known that high purity $^{211}Rn$ could be prepared by bombarding $^{209}Bi$ with $^{7}Li$ particles, for example, in a type of method such as that described in U.S. Pat. No. 4,364,898 which issued Dec. 29, 1982. However, that patent and related prior art methods do not disclose or suggest a method for simultaneously producing substantially equal amounts of radionuclides that are suitable for double-labeling compounds in the manner explained above.

In the applicants' co-pending U.S. patent application, Ser. No. 598,624, which was filed Apr. 10, 1984, there is disclosed a process for reliably producing a $^{211}At$ radiopharmaceutical by a process that includes forming a suitable bismuth target and then irradiating it with alpha particles, preparatory to chemically treating the target to elute $^{211}At$, which is then collected in a controlled volume of eluent for use in selected radiopharmaceutical procedures. The disclosure of that co-pending U.S. patent application is referred to and incorporated herein by reference for its teaching of suitable techniques for forming radiation target bodies and target backing materials, as well as for the techniques described therein for irradiating such target materials.

OBJECTS OF THE INVENTION

A primary object of the invention is to provide a method for reliably and consistently preparing nearly equal amounts of $^{211}Rn$ and $^{125}Xe$, simultaneously, using a one-step irradiation of a single target to form useful quantities of selected isotopes, followed by a chemical extraction and purification procedure, all hereinafter referred to simply as a one-step chemical procedure.

Another object of the invention is to provide a method for simultaneously obtaining comparable quantities of high purity $^{123}I$ and $^{211}At$.

A further object of the invention is to provide a method for preparing at least two radionuclides in the same chemical form and media so that they can be used together to facilitate subsequent chemistry.

Yet another object of the invention is to provide a method for the simultaneous preparation of $^{211}Rn$ and $^{125}Xe$, which method utilizes a novel one-step irradiation and subsequent distillation and collection procedure, our so-called one-step chemical procedure.

Still another object of the invention is to provide a method of for readily preparing $^{211}Rn$, $^{211}At$, $^{125}Xe$, $^{125}I$, $^{123}Xe$, and $^{123}I$ using a one-step chemical procedure that yields a first mixture of about equal amounts of $^{211}Rn$ and $^{125}Xe$, and a separate second mixture of about equal amounts of $^{123}I$ and $^{211}At$.

Additional object and advantages of the invention will become apparent to those skilled in the art from the description of it presenting herein, considered in conjunction with the accompanying drawings.

SUMMARY OF THE INVENTION

In one preferred arrangement of the invention almost equal quantities of $^{211}Rn$ and $^{125}Xe$ are prepared using a one-step chemical procedure in which a suitably irradiated fertile target material, such as thorium-232 or uranium-238, is treated to extract those radionuclides from it. In the same one-step chemical procedure about equal quantities of $^{211}At$ and $^{123}I$ are prepared and stored for subsequent use. In a modified arrangement of the method of the invention, it is practiced to separate and store about equal amounts of only $^{211}Rn$ and $^{125}Xe$, while preventing the extraction or storage of the radionuclides $^{211}At$ and $^{123}I$.

DESCRIPTION OF SOME ARRANGEMENTS OF THE PREFERRED METHOD

Figure 1:
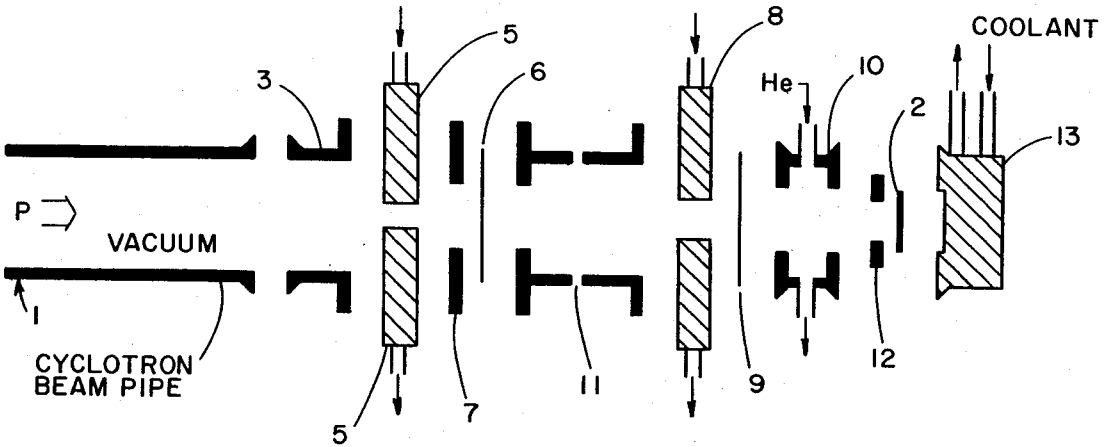
FIG. 1 is a schematic side plan view, partly in cross section, of a fertile metal target material and associated cooling assembly, shown in combination with conventional cyclotron proton-beam output pipe and associated collimators, cooling systems for controlling the movement and application of protons from the cyclotron toward the fertile metal target, according to an initial step in the method of the invention.
Figure 2:
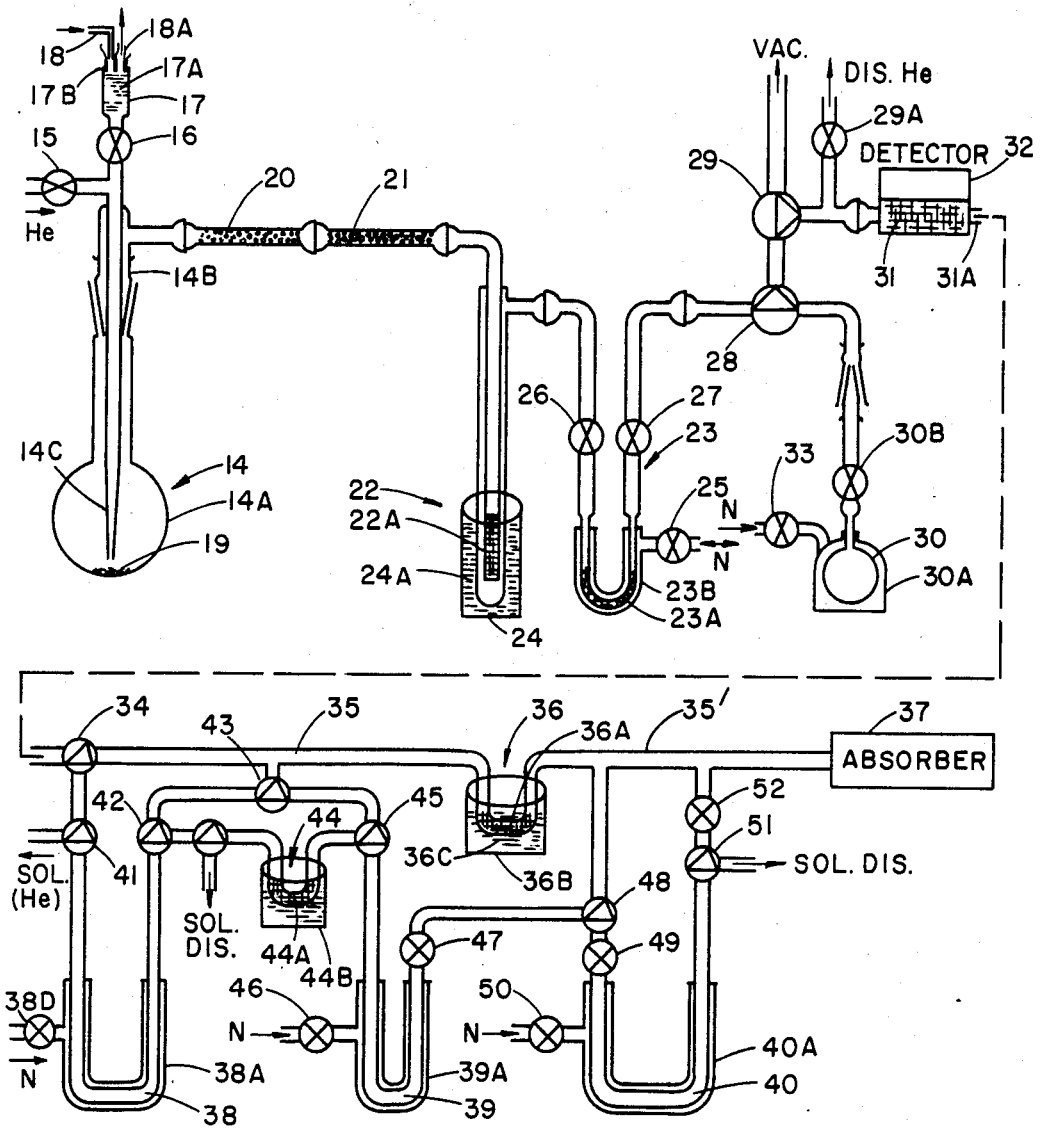
FIG. 2 is a schematic illustration of a novel distillation and collection apparatus that is assembled in a system which is used in practicing a one-step chemical procedure, according to the method of the invention, to extract and store substantially equal quantities of $^{211}Rn$ and $^{125}Xe$ in one container, while also being operable to separate and store about equal quantities of $^{211}At$ and $^{123}I$ in a separate container.

To facilitate a description of the preferred arrangement of the method steps of the invention, reference is first made to FIGS. 1 and 2 of the drawing in order to explain one type of suitable apparatus that can be used for practicing the invention. A first necessary step of the disclosed method is to provide a suitably irradiated body of fertile heavy metal such as thorium-232 or uranium-238. A variety of different suitable conventional particle accelerators may be used as a source of irradiation to achieve that desired end. One such suitable source is illustrated schematically in FIG. 1, as a cyclotron beam pipe 1 that is operable to accelerate protons (P) at predetermined energies. In one prototype implementation of the subject invention, the alternating gradiant synchrotron cyclotron that is presently in operation at Brookhaven National Laboratory, Upton, N.Y. was used successfully to accelerate protons through a beam line output pipe and associated collimators, of the type illustrated schematically in FIG. 1. Such a mode of operation is indicated at the left side of the beam pipe 1 in FIG. 1, by an arrow labeled P, which represents a beam of protons that have been accelerated by the cyclotron, in a well-known manner, in the direction of the arrow. Positioned adjacent to the outlet end of the beam pipe 1 is a body of target material 2 formed of a $^{232}Th$. (Alternatively, as more fully explained below, in some applications of the method uranium-238, or other fertile heavy metal, may be used for the target material 2). In order to focus the proton beam P for appropriate impingement on the body of target material 2, there is mounted in suitable conventional fashion adjacent to the outlet end of the beam pipe 1 an isolating insulator 3 that supports water cooled collimator 5 for the output beam line P. An optional suitable conventional foil 6, which may be formed of Dural metal or other conventional material, is mounted in space relation to the collimator 5 by a suitably apertured insulator 7, in a manner well known to those skilled in the cyclotron field. A second water-cooled collimator 8, which has a central aperture of a desired predetermined diameter, is used to further focus the beam P and to conduct heat from an aluminum window 9. It should be understood that the arrows shown in FIG. 1, respectively adjacent to collimators 5 and 8, represent a suitable coolant, such as water, that is circulated through tubes in the collimators.

The window 9 is used to protect the accelerator vacuum should there be degradation of the target and to shield the vacuum from the helium cooling gas. This window is positioned between the collimator 8 and a helium (He) cooled chamber 10. The proton beam outlet assembly also includes a larger evacuated chamber 11, positioned between the Dural foil 6 and the collimator 8. An annular collar 12 is secured over the target material 2 for the purpose of holding it tightly in place within a holder assembly 13 while the target is being irradiated by proton particles. The size of the body of target material 2 may vary from a gram or so up to a few kilograms of the selected fertile metal. When larger targets are used, a suitable conventional target holder assembly 13, which is preferably water cooled by passing coolant through pressure tubes tightly packed with the target material, is used to appropriately remove heat from the target during its bombardment with protons. However, in one preferred prototype arrangement of the method of the invention, the target material 2 comprised a body of about one gram of $^{238}Th$, which was simply wrapped in a foil of aluminum, which foil was about 1 mil thick and was not chilled by using a liquid coolant. The purpose of the aluminum foil was to prevent loss of fissionable material. It will be recognized that other suitable conventional target assemblies, and related sources of proton irradiation, may be used, in practicing modifications of the method of the invention.

In order to best practice the next step of the method, which comprises a novel one-step chemical distillation and collection procedure, a suitable type of apparatus is shown in FIG. 2, as such an apparatus was assembled into a working system to successfully demonstrate operability of the invention. The novel arrangement of apparatus shown in FIG. 2 comprises a still 14 that is formed of a lower vessel 14A, an exhaust stem 14B, and an inlet tube 14C. All of those components may be formed of a conventional Pyrex glass, stainless steel or other suitable non-corrosive material. The inlet tube 14C is coupled through a suitable conventional on-off valve 15 to a source of helium gas (represented by the He symbol and arrow in FIG. 2). In addition, the inlet tube 14C is connected, as shown, through another suitable conventional on-off valve 16 to a Pyrex glass container 17, that contains a mixture 17A of hydrochloric acid (HCl), nitric acid ($HNO_3$) and hydrofluoric acid (HF). In the preferred arrangement being described, a mixture of about ninety percent HCl, about ten percent $HNO_3$ and a trace of HF acid is used; however, it will be recognized that other ratios may be used in practicing the invention in applications where more time is available for dissolving the target material. The upper end of the container 17 is provided with an aperture stopper 17B that supports an inlet tube 18, and an outlet tube 18A for introducing helium from a suitable source (also designated He) into container 17, and then removing it from the container. As will be more fully explained below, the source of helium gas that is connected to the inlet tube 18 is used to selectively force the mixture of acids 17A through the valve 16 (when it is opened), into the inlet tube 14C, while the exhaust tube 18A is used to vent surplus helium out of container 17.

At the bottom of distillation vessel 14A, there is illustrated a body of partially dissolved residue 19, which is the $^{232}Th$ irradiated target material placed there in practicing the invention, as will be more fully explained below in connection with the operation of the method of the invention. In describing the remainder of the apparatus and assembled system illustrated in FIG. 2, it should be understood that the illustrated tubing or piping used to inter-connect the respective components, which are specifically identified below with reference numbers, may be formed of any suitable conventional glass or stainless steel material. Such conventional connecting means are provided with precision-ground-glass or other fluid-tight connecting surfaces that are effective to form the necessary fluid-type system, as is well known in the art. Accordingly, not all of the interconnected tubes or pipettes are identified by reference numerals herein. Those skilled in the art will also recognize that the toxic and corrosive nature of the acids and radio-active gases that are handled by the system in practicing the method of the invention require the use of Pyrex glass or other suitable material that is capable of safely confining such materials, without chemically interacting with them. Likewise, the internal diameters of the selected tubes or pipettes must be sufficient to maintain the desired flow rates (described below), that are used in practicing the method of the invention.

A body of granular calcium chloride ($CaCl_2$) 20 is positioned downstream from the still 14 in order to dry the gases that are discharged from the still when the subject invention is practiced. Preferably the $CaCl_2$ is retained in a readily removable pipette section, in any well known manner, as shown in FIG. 2. Similarly, a body of granular Ascarite material 21 is positioned downstream from the still 14 to absorb any nitrous oxide ($N_2O$) gas or other oxides of nitrogen that may be discharged from the still. A suitable conventional silver mesh trap 22, having a piece of silver mesh 22A housed therein in the usual fashion, is provided with its inlet connected to receive gas discharged from the still 14, as shown in FIG. 2, and with its discharge end connected to a second trap 23. A body of activated carbon 23A is disposed in the lower portion of trap 23. A suitable conventional coolant-retaining jacket 24 is disposed around the silver-mesh trap 22, and is partly filled with ice water 24A, to maintain the silver mesh 22A at about 0° C., for the purpose of the present invention that is described below. Another similar conventional coolant-retaining glass jacket 23B is positioned around the second trap 23, and is selectively supplied through an on-off valve 25 with liquid nitrogen, or other suitable coolant, from a conventional source (designated by the N and two-headed arrow in FIG. 2). As explained below, the liquid nitrogen N is used to cold trap 23 to about −196° C. during one phase of the subject method. A pair of on-off valves 26 and 27 are used in the method of the invention to control the flow of gases into and out of the second trap 23.

Downstream from the second trap 23, a pair of three-way valves 28 and 29 are connected by conventional tubing, as shown in FIG. 2, to selectively control the flow of gas from the second trap 23 to a storage container 30, and to control the application of vacuum pressure from a suitable conventional source (designated VAC, and with an arrow in FIG. 2) connected by the tubing at the upper end of valve 29. The valves 28 and 29 are also used to control the flow of gas from the second trap 23 into a suitable conventional chromatographic gas separator 31 and associated detector 32, which is used in the method of the invention in a manner that is explained below. The storage container 30 is provided with a coolant-retaining jacket 30A, which is connected through an on-off valve 33 to a suitable source of liquid nitrogen (designated N), as shown in FIG. 2. The tubular outlet 31A of the chromatographic separator 31 is connected, as shown by the dashed line in FIG. 2, to a three-way valve 34, which has one of its ports connected through a suitable Pyrex glass tube 35 containing another silver mesh trap 36, arranged as shown in FIG. 2. The U-shaped portion of trap 36 houses a body of silver mesh 36A, while a conventional coolant-retaining container 36B holds ice water 36C that chills the trap to about 0° C. while the method of the invention is being practiced with the apparatus. The opposite end of the tube 35 is connected to a suitable conventional absorber, or other discharge absorbing chamber 37, thereby to provide means for disposing of surplus or waste materials resulting from operation of the method of the invention.

The illustrated system further includes three appropriately cooled additional collecting chambers 38, 39 and 40, which are connected in series by associated conventional tubing or pipettes, as illustrated in FIG. 2. A pair of threeway valves 41 and 42 are positioned to in the tubing connecting the chamber 38, as shown, to selectively control the introduction of gas from the chromatographic separator 31 into the chamber 38. Alternatively, the values 41 and 42 control a supply of cleaning solvent that can be flushed into chamber 38 from a suitable source (designated SOL in FIG. 2) through a solvent supply tube shown connected to the left side of valve 41. A conventional coolant-retaining jacket 38A is positioned around the chamber 38 and is supplied through an on-off valve 38D from a conventional source of liquid nitrogen (designated N in FIG. 2).

The three-way valve 42 is operable to either discharge gas through another three-way valve 43 into the tube 35, or to connect the chamber 38, through a third silver trap 44, to yet another three-way valve 45, thereby to enable operation to the one-step chemical procedure of the method of the invention, in the manner that is described below.

The second collecting chamber 39 is also surrounded by a conventional coolant-retaining jacket 39A which is supplied with liquid nitrogen, through the on-off valve 46, from a conventional source (designated N) of such nitrogen, or other suitable coolant. The second collecting chamber 39 is connected through threeway valves 47 and 48, as shown, to the tube 35. Alternatively it may be connected through the three-way valve 47 and on-off valve 49 to the third collecting chamber 40. Chamber 40 also is surrounded by a coolant-retaining jacket 40A, which is supplied through on-off valve 50 from a suitable source of liquid nitrogen (designated N, in FIG. 2). Finally, the third collecting chamber 40 is connected, as shown, through a three-way valve 51 and an on-off valve 52 to the tube 35 and absorber 37. Alternatively, the three-way valve 51 may be used to discharge solvent flushed through the chamber 40 into a suitable discharge tube (designated SOL.DIS, in FIG. 2).

Now that one form of apparatus and system suitable for practicing the invention, as shown in FIGS. 1 and 2, have been described, some preferred arrangements of the process steps of the method of the invention will be explained in order to enable those skilled in the art to efficiently prepare about equal amounts of $^{211}$Rn and $^{125}$Xe in a storage container, while in the same one-step chemical procedure preparing about equal amounts of $^{211}$At and $^{123}$I in a separate collection chamber. Subsequently, it will be explained how a system such as that shown in FIG. 2 can also be operated in a one-step chemical procedure to prepare about equal amounts of $^{211}$Rn and $^{125}$Xe, without collecting the radionuclides $^{211}$At and $^{123}$I.

To practice the first preferred arrangement of the method of the arrangement, a suitable predetermined body of thorium ($^{232}$Th), as shown by the target body 2 in FIG. 1, is mounted as a target for proton (P) irradiation from the cyclotron beam pipe 1, as illustrated in FIG. 1. The irradiating protons must be supplied from the accelerator with at least two GeV energy, and to optimally irradiate the target in a most preferred arrangement of the method of the invention, which produces desirably high yields of $^{125}$Xe and $^{211}$Rn, the proton energy is maintained at about 28.5 GeV for about 15 hours of irradiation. Uranium ($^{238}$U) can be used, in alternative arrangements of the invention, for the body of target material 2 shown in FIG. 1, provided that in such a case the irradiating protons (P) are supplied from the accelerator beam pipe 1 at an energy of at least three GeV, for about 15 hours of irradiation.

Immediately after the 15 hours of irradiation, the body of thorium 2 is placed in a suitable vessel, such as the still 14 shown in FIG. 2, and dissolved in a selected mixture of acids. With the system shown in FIG. 2, after the body of irradiated thorium target material is positioned in the still (the partially dissolved target material is designated 19), 14, valve 16 is opened and helium gas is supplied at a predetermined relatively low pressure through tube 18 to force the mixture of acids 17A from the container 17 into the vessel 14A of the still. The mixture of acids 17A used in the preferred arrangement of the method of the invention comprises about equal molar percentages of concentrated hydrochloric acid (HCl) at and concentrated nitric acid ($HNO_3$), and a trace of hydrofluoric acid (HF). Other concentrations of acid mixtures may be used in alternative arrangements of the method of the invention, but it will be recognized that the target material disillusion time will be changed as a consequence.

Due to the quite similar half-lives of $^{211}$Rn and $^{125}$Xe, respectively, 14.8 hours and 16.8 hours, the ratio of yields and the constant radionuclidic purity of those elements achieved by bombarding the body of thorium target material with protons has been found to be about equal. The lower limit of the effective cross section of $^{211}$Rn and $^{125}$Xe from such a 15 hour proton bombardment of the aluminum foil encased body of thorium target material 2 was determined for about 28 GeV protons to be about $0.72\pm0.1$ mb and $1.0\pm0.1$ mb, respectively. The slight difference in the effective cross sections compensate for the small differences in the half-lives of $^{211}$Rn and $^{125}$Xe.

The advantages of the initial irradiation step of the method of the invention will be better understood when it is recognized that useful ratios of $^{211}$Rn and $^{125}$Xe cannot be effectively produced by conventional photospallation of $^{232}$Th, because the cross section of production of $^{211}$Rn is at least 100 times smaller than for proton activation of $^{232}$Th. The fission cross section for production of $^{125}$Xe is almost the same order of magnitude as proton activation of $^{232}$Th. Therefore, the mixture of these two gases produced by a photospallation of $^{232}$Th has been found to be practically useless when it is desired to prepare about equal amounts of those radionuclides.

In the method of the invention, the irradiated thorium target material (partly dissolved at 19) is dissolved in the vessel 14A at about normal room or ambient temperature. The valve 16 is then closed, and the valve 15 is opened to supply helium carrier gas from the designated source (He), at about one atmospheric pressure and at a flow rate of a few milliliters (ml) per minute. It should be understood as the description of the method of the invention proceeds that faster flow rates of the carrier gas will change the rate of collection of the xenon and radon radioactivities as they are prepared by practicing the method. The helium carrier gas forces the xenon and radon radioactives through the granular calcium chloride 20 and granular Ascarite 21, which respectively are effective to dry the gases and to stop oxides of nitrogen ($N_xO$) from passing into the rest of the system. Subsequently, the helium carrier gas and entrained radioactivities are passed through the 10 to 20 grams of silver mesh 22A in chilled trap 22 to eliminate radiohalogens. The silver mesh trap 22 is cooled to about 0° C. by a bath of ice water 24A supplied in container 24 from a conventional source. Such a reduced temperature is required due to the high vapor pressures of the entrained astatine compounds. As indicated above, the relatively low flow rate of the helium carrier gas is particularly important at this point in the system, in order to maintain the operating efficiency of the chilled silver trap 22.

The valves 26 and 27 are open during this phase and valves 28 and 29 are positioned to connect the second trap 23 through open discharge valve 29A to a suitable carrier gas discharge (designated DIS He in FIG. 2). The body of activated charcoal 23A in the second trap 23 is cooled to about −196° C. by providing a bath of liquid nitrogen in the coolant-retaining sleeve 23B. Such coolant is selectively supplied through the valve 25 from the source designated N. It should be understood that the temperature of the activated charcoal 23A may be variable in given applications of the method of the invention but, obviously, the second trap 23 must be maintained at a temperature less than the boiling point of Xe (−107° C.) in order to achieve the objectives of the invention. It will also be apparent that coolant means other than liquid nitrogen may be used, for example liquid oxygen or other materials can be used in given applications where resultant risk of explosions, or other associated risks, are acceptable. Similarly, although activated charcoal 23A is used in the second trap in describing the preferred method of the invention, other suitable materials which provide similar collecting surfaces, such as commercially available silica gel, etc, may be used in the method of the invention for collecting and subsequently releasing the desired Xe and Rn radionuclides, while appropriately entrapping or retaining At and I radioactivites, according to the method of the invention.

The flow of helium carrier gas supplied through valve 15 is maintained until essentially all of the radioactive gases have been transferred from vessel 14A into the first and second traps 22 and 23. The time interval for such transfers will vary depending on the size of the body of irradiated thorium material 2 (or 19) that is dissolved in the distillation vessel 14A. For a one gram target of $^{232}$Th, the flow of helium gas will achieve that objective in a few minutes. When that transfer of the radioactivities has taken place, the supply of helium carrier gas is discontinued by closing valve 15. Then, discharge valve 29A is closed and the three-way valve 29 is moved to connect the second trap 23 to a source of vacuum (designated VAC, in FIG. 2), which is maintained at about $10^{-4}$ TORRS pressure. The second trap 23 is warmed to about ambient temperature, by using a pump or other suitable conventional means for removing liquid nitrogen from the coolant-retaining sleeve 23B, through valve 25, to return the nitrogen to the source N. Alternatively, value 25 may simply be closed, and the liquid nitrogen can be discharged from the container 23B, through a suitable spigot (not shown). Such heating of the activated carbon 23A is effected after the three-way valve 29 is again moved to thereby connect the second trap 23 to the chromatographic separator 31. It should be understood that a vacuum pressure is maintained on the second trap 23, although it is now disconnected from the vacuum pump or other source of vacuum (VAC) shown in FIG. 2. Consequently, due to the heating of the activated charcoal 23A and the existing vacuum pressure, the radionuclides $^{211}$Rn and $^{125}$Xe are vacuum transferred, absent any helium carrier gas, into the chromatographic separator 31.

In operating the system shown in FIG. 2, an operator monitoring the radiation detector 32 that is associated with separator 31, first separates the radio-xenons ($^{123}$Xe and $^{125}$Xe) by conventional use of the molecular sieve or other chromatographic separator 31, so that the xenons are passed through suitably positioned valves 34 and 41 and are stored in first collecting chamber 38. When the operator monitoring detector 32 determines that essentially all of the radio-xenons ($^{123}$Xe and $^{125}$Xe) have passed, he adjusts the valves to collect the radon activities $^{210}$Rn and $^{211}$Rn in second collection chamber 39. Valve 34 is moved to direct flow to valve 43, which is positioned to direct flow through valve 45 to the second chamber 39. In that phase, valves 47 and 48 are positioned to permit carrier gas to be discharged from second chamber 39 to the absorber 37. Thus, $^{210}$Rn and $^{211}$Rn are collected in the second collecting chamber 39. Now, about 10 to 15 hours is allowed to pass so that essentially all of the $^{210}$Rn in chamber 39 decays to $^{210}$At which is undesirable activity.

During that same decay period, the $^{123}$Xe in first collecting chamber 38 decays to $^{123}$I. The optimum decay time allowed in a given application of the method will depend upon the desired final radionuclidic purity requirements. About 7 hours of decay time will be optimum for $^{123}$I.

Subsequent to the decay period, the valves are adjusted so that the pure $^{211}$Rn (free of $^{210}$Rn) in chamber 39 can be transferred to the first collecting chamber 38 where $^{211}$Rn decays to $^{211}$At. Then, transfer the $^{125}$Xe to the third collecting chamber 40.

The radiohalogen ($^{210}$At) formed in the second collecting chamber 39 is prevented from entering the first chamber 38 during this transfer, by passing the gases from chamber 39, through three-way valve 45, into silver trap 44 which is maintained at about 0° C. (in the manner described above). Again, the gas pressurizing means for moving the radioactivities from second collecting chamber 39 to first chamber 38 are supplied by adjusting the valves of the system to cause He to flow through valve 34, trap 36 and valve 48 into second chamber 39. Gas leaving chamber 39 flows through valve 45, trap 44 and valve 42 into first collecting chamber 38, from which it is discharged through valve 41 to a suitable discharge port (designated He, with a discharge arrow, in FIG. 2).

Next, the $^{211}$Rn now in chamber 38 is allowed to decay to $^{211}$At for about 5 to 10 hours. The $^{123}$Xe in first chamber 38 is allowed to decay for about 7–15 hours to $^{123}$I. The optimum decay time will depend upon the desire final radionuclidic purity requirements in given applications. About 7 hours has been found optimum for the preparation of $^{123}$I.

After the desired decay of $^{123}$Xe, any $^{125}$Xe and any remaining $^{211}$Rn in the first chamber 38, $^{123}$Xe and $^{125}$Xe are separated from $^{211}$At and the $^{123}$I therein and are transferred for storage into the third chamber 40. For that purpose the flow of He is through valves 34 and 41, into chamber 38, then through valves 42 and 43, through trap 36 and valves 48 and 49 into chamber 40.

At this point in the practice of our method, about equal volumes of the radio activities $^{211}$Rn and $^{125}$Xe are present in the third chamber 40. Accordingly, those radio activities can be removed from the chamber 40 by any suitable conventional means and used for dual labeling of compounds or for any other desired use thereof.

The $^{123}$I and $^{211}$At present in the first collecting chamber 38 can be extracted by conventional means from the chamber 38 for use in the synthesis of double-labeled radiopharmaceuticals, or for any other desired application.

Now that a first arrangement of the one-step chemical procedure of the method of the invention has been described, an alternative arrangement will be explained whereby the type of apparatus shown in FIG. 2 can be used to prepare a mixture of about equal amounts of the radionuclides $^{211}$Rn and $^{125}$Xe, without bothering with the collection of other radioactivities.

The first step in this modification of the invention is the same as that described above; namely, a selected body of $^{232}$Th or $^{238}$U material is irradiated with protons, as described above with reference to the system shown in FIG. 1. A critical difference in this modified form of the invention is that the body of target material 2 is allowed to decay for at least 15 hours, following its irradiation, before it is dissolved in the vessel 14A of still 14. That delay is critical in order to obtain high radionuclidic purity $^{211}$Rn and $^{125}$Xe. After 15 hours decay, the body of target material is dissolved in the dissolution vessel 14A, by subjecting it to the type of acid mixture described above. After the dissolution of the target material 19 is completed, a relatively low flow rate of helium carrier gas is admitted through valve 15 to carried the $^{211}$Rn and $^{125}$Xe radionuclides through the calcium chloride drying material 20 and the Ascarite filter 21 and into the chilled silver mesh trap 22. As explained above, the silver trap 22 is effective to eliminate any radiohalogens, such as $^{211}$At and $^{123}$I, from the carrier gas and the other entrained radioactivities. As that gas mixture passes into the second trap 23, which is chilled to about −196° C. by the liquid nitrogen supplied to the coolant-retaining sleeve 23*b* from source N, the $^{211}$Rn and $^{125}$Xe radionuclides are collected on the activated charcoal 23A in the second trap 23.

After all of those radionuclides have evolved from the dissolved target material 19, the flow of helium gas is discontinued by closing the valve 15 and the carrier gas discharge valve 29A. Then, the three-way valve 28 is adjusted to connect the output of the second trap 23 to a storage vessel 30, through an on-off valve 30B, which is placed in its open position. In order to heat the radionuclides trapped in the activated carbon 23A above their boiling point, liquid nitrogen is exhausted from the coolant-retaining sleeve 23B and returned through valve 25A to the source N of liquid nitrogen or otherwise disposed of, as explained earlier. After the temperature of the activated charcoal 23A has risen to at least the boiling point of Xe (−107° C.) that gas flows into the chamber 30, and when the temperature of the activated charcoal 23A is raised to at least the boiling point of Rn (−62° C.) that gas is also collected in the storage vessel 30. As explained above, due to the closely related half-lives of the radionuclides $^{211}$Rn and $^{125}$Xe, about equal amounts of these radionuclides will be stored in the vessel 30, following this operation of the method of the invention. Vacuum transfer of the radionuclides from the second trap 23 to the storage vessel 30 may be facilitated in the manner more fully explained above, by application of vacuum pressure through three-way valve 29, from vacuum source (VAC), if necessary to achieve complete transfer of those gases. The storage vessel 30 is maintained at about −196° C. to facilitate storage of the radionuclides therein. Liquid nitrogen may be introduced through on-off valve 33 from a suitable source N, into coolant-retaining sleeve 33A, for that purpose.

Of course, the approximately equal amounts of the radionuclides $^{211}$Rn and $^{125}$Xe, thus stored in the mixture in vessel 30, may subsequently be used for any desired application, such as those discussed above with respect to the first preferred form of the method of the invention.

From the foregoing description of the invention, it will be apparent to those skilled in the art that various further alternative arrangements of the inventive method, and alternative system arrangements, may be practiced, based upon the disclosure presented herein. Accordingly, it is our intention to encompass the true scope of the invention within the limits of the following claims.

We claim:

1. A method for simultaneously preparing a mixture of about equal amounts of $^{211}$Rn and $^{125}$Xe, and a second mixture of about equal amounts of $^{211}$At and $^{123}$I with a proton-irradiation procedure followed by a one-step chemical procedure, said method comprising;

(a) irradiating a body of material selected from the group consisting of $^{232}$Th and $^{238}$U for about 15 hours with protons that have been accelerated to at least 2 GeV, (b) promptly dissolving said irradiated body of material in a vessel containing a mixture of hydrochloric acid, nitric acid and hydrofluoric acid, (c) forcing a stream of helium (He) carrier gas into the vessel at a predetermined flow rate to entrain radionuclides of gaseous $^{210}$Rn, $^{211}$Rn, $^{123}$Xe and $^{125}$Xe and trace amounts of radiohalogens and remove them from said vessel, (d) passing the stream of helium carrier gas and entrained radionuclides through a silver mesh trap that is maintained at a temperature of about 0° C., thereby to eliminate radiohalogens from said stream of gases, (e) passing said stream of gases through a second trap that is maintained at a temperature of about −196° C., thereby to entrap $^{211}$Rn and $^{125}$Xe in said second trap, (f) continuing to pass said carrier gas and any entrained radionuclides through a combination chromatographic separator and detector that is operated to first pass essentially of the $^{123}$Xe and $^{125}$Xe into a first collecting chamber that is maintained at about −196° C., and that is subsequently operated to pass $^{210}$Rn $^{211}$Rn into a second collecting chamber that is maintained at about −196° C., (g) allowing the radionuclides in said first and second collecting chamber to decay for about 10 to 15 hours, thereby to produce $^{123}$I from the $^{123}$Xe in said first chamber and to produce $^{211}$At from the $^{211}$Rn in said second chamber, (h) transferring $^{125}$Xe and the remainder of the $^{211}$Rn from said first collecting chamber into a third collecting chamber that is maintained at about −196° C., and then transferring $^{211}$At from the second collecting chamber, through a trap to remove $^{210}$At, into said first collecting chamber, thereby to leave about equal amounts of $^{123}$I and $^{211}$At in said first chamber, while leaving about equal amounts of $^{211}$Rn and $^{125}$Xe in said third chamber.

2. A method as defined in claim 1 wherein said $^{232}$Th is irradiated for about 15 hours with protons accelerated to about 28 GeV.

3. A method as defined in claim 1, except that rather than irradiating $^{232}$Th, said body of irradiated material is $^{238}$U, and said irradiation is continued for about 15 hours with protons accelerated to at least 3 GeV.

4. A method as defined in claim 1 wherein said mixture of acids comprises about ninety percent concentrated hydrochloric acid, about ten percent nitric acid, with a trace amount of hydrofluoric acid therein.

5. A method as defined in claim 2 wherein said radiohalogens that are eliminated from the carrier gas by said first trap comprise $^{210}$At and $^{211}$At.

6. A method as defined in claim 5 wherein said predetermined flow rate of the carrier gas is about 1 to 3 milliliters per minute.

7. A method as defined in claim 5 wherein said second trap contains activated carbon or a silica gel mesh.

8. A method as defined in claim 1, including the following step after step (g), which is effective to eliminate $^{210}$Rn and $^{210}$At from the first collecting chamber;

(g′) transferring substantially pure $^{211}$Rn from the second chamber to the first chamber and allowing further decay of substantially all of the $^{123}$Xe and of some $^{211}$Rn, to $^{123}$I and $^{211}$At, respectively.

9. A method for simultaneously preparing about equal amounts of $^{211}$Rn and $^{125}$Xe, using a proton irradiation procedure followed by a one-step chemical procedure, said method comprising;

(a) irradiating a body of material selected from the group consisting of $^{232}$Th and $^{238}$U for about 15 hours with protons accelerated to at least 2 GeV, (b) discontinuing irradiation of said body for a period of about 15 hours to permit decay of radionuclides having lives shorter than that period, (c) disssolving said body in a vessel containing a mixture of hydrochloric acid, nitric acid and trace amounts of hydrofluoric acid, (d) removing gaseous $^{211}Rn$ and $^{125}Xe$ from said vessel by forcing a stream of helium carrier gas into the vessel at a flow rate of about 1 to 3 milliliters per minute, (e) passing the stream of carrier gas and entrained $^{211}Rn$ and $^{125}Xe$ gases through a silver mesh trap that is maintained at a temperature of about 0° C., thereby to eliminate radio-halogens from the stream of carrier gas and entrained radionuclides, (f) passing said stream of gases through a second trap that is maintained at a temperature of about −196° C., thereby to entrap the radionuclides in said second trap, (g) discontinuing the stream of carrier gas through said first trap, and vacuum transferring the $^{211}Rn$ and $^{125}Xe$ radionuclides from said second trap into a storage vessel that is maintained at about −196° C., thereby to provide about equal amounts of said to radionuclides in said storage vessel.

10. A method as defined in claim 9 wherein said second trap contains activated charcoal that is maintained at about −196° C.

11. A method as defined in claim 9 wherein said second trap contains silica gel mesh.

12. A method as defined in claim 9, except that said body of irradiated material consists of $^{238}U$, rather than of $^{232}Th$, and is irradiated for about 15 hours with protons accelerated to at least 3 GeV.

13. A method as defined in claim 12 wherein said $^{238}U$ is irradiated with protons accelerated to about 28.5 GeV.

* * * * *